US005690238A

United States Patent [19]

Schmehr

[11] Patent Number: 5,690,238

[45] Date of Patent: Nov. 25, 1997

[54] POINT OF PURCHASE COMPATIBLE MERCHANDISING SYSTEM

[75] Inventor: William R. Schmehr, Wheaton, Ill.

[73] Assignee: Ace Hardware Corporation, Oak Brook, Ill.

[21] Appl. No.: 547,590

[22] Filed: Oct. 24, 1995

[51] Int. Cl.[6] ..... A47F 5/00

[52] U.S. Cl. ..... 211/106

[58] Field of Search ..... 211/106, 59.1, 211/57.1, 87, 90; 248/220.21, 220.41

[56] References Cited

U.S. PATENT DOCUMENTS

| | | | |
|---|---|---|---|
| 3,419,155 | 12/1968 | Black et al. | 211/90 |
| 3,659,722 | 5/1972 | Carroll | 211/106 |
| 3,850,300 | 11/1974 | Young, Jr. | 211/59.1 X |
| 4,072,246 | 2/1978 | Paulin | 221/307 |
| 4,106,736 | 8/1978 | Becker, III et al. | 211/106 X |
| 4,114,763 | 9/1978 | Hochman | 211/57.1 |
| 4,246,710 | 1/1981 | Mixer | 40/16.4 |
| 4,340,144 | 7/1982 | Cousins | 211/87 |
| 4,344,540 | 8/1982 | Marschak | 211/106 |
| 4,415,091 | 11/1983 | Wolff | 248/220.21 X |
| 4,461,443 | 7/1984 | Dauman | 211/87 X |
| 4,463,510 | 8/1984 | Windish | 40/124.4 |
| 4,492,169 | 1/1985 | Ware et al. | 248/220.43 X |
| 4,583,648 | 4/1986 | Buffington et al. | 211/90 |
| 4,591,057 | 5/1986 | Garfinkle | 211/59.1 |
| 4,775,054 | 10/1988 | Dixon | 211/57.1 |
| 4,842,230 | 6/1989 | Cobb et al. | 211/106 X |
| 4,865,205 | 9/1989 | Thorneburg et al. | 211/59.1 |
| 5,031,783 | 7/1991 | Goudreau | 211/59.1 X |
| 5,038,943 | 8/1991 | Reinke | 211/59.1 |
| 5,170,897 | 12/1992 | Wentworth | 211/189 X |
| 5,231,779 | 8/1993 | Valiulis et al. | 40/649 |
| 5,335,794 | 8/1994 | Reedy | 211/13 |
| 5,351,842 | 10/1994 | Remmers | 211/90 |
| 5,398,824 | 3/1995 | Wolff et al. | 211/87 |

*Primary Examiner*—Alvin C. Chin-Shue
*Assistant Examiner*—Sarah L. Purol
*Attorney, Agent, or Firm*—Hill, Steadman & Simpson

[57] ABSTRACT

A display rack and a system for displaying merchandise are provided. The display rack includes a pair of brackets attachable to a vertical surface a remote distance apart. Rigid rods are connected between the rack and extend to the vertical surface. Between the rigid rods, an additional bracket or brackets may be attached. Alternatively, or in addition to, the rack may be provided with a shelf. Further, an additional rack may be suspended from the longitudinal rods of the rack. A number of racks of varying dimension may be mounted to the vertical surface to display merchandise in a space-saving manner.

18 Claims, 6 Drawing Sheets

POINT OF PURCHASE COMPATIBLE MERCHANDISING SYSTEM

BACKGROUND OF THE INVENTION

The present invention generally relates to a system for displaying merchandise. More specifically, the present invention relates to a rack system for use in a point of purchase merchandising system including a plurality of racks that may be variably vertically displaced and horizontally displaced resulting in increased space-saving capabilities.

It is, of course, generally known to provide racks for displaying and storing merchandise at, for example, a store, such as a hardware store, grocery store or the like. Many such rack systems lack the variability required for saving space and altering the arrangement depending on the merchandise to be displayed. Known rack and display systems are shown and described in U.S. Pat. Nos. 4,072,246; 4,114,763; 4,775,054; and 4,865,205.

U.S. Pat. No. 4,072,246 relates to a display rack for packages of hardware and like articles. The rack includes a support and a plurality of elongate elements projecting outwardly from the support in generally parallel position from which the packages can be suspended. The elements have free outer end portions over which the packages can be slidably fitted onto and removed from the elements. The elements are arranged to incline downwardly to a slight extent away from the support when the rack is in use so that packages suspended on the elements tend to slide toward the outer end portions under the action of gravity.

U.S. Pat. No. 4,114,763 relates to a composite unit for displaying merchandise having a rack with hook elements releasably mounted thereon. A safety bumper guard may be connected to the rack to prevent an inadvertent encounter with a hook member of the display. The rack is vertically adjustable in a pair of substantially parallel upright channel members. A plurality of the racks may be simultaneously mounted in the channel members. A first rack is demountably connected to an upright sleeve and in a substantially fixed position relative thereto. A plurality of additional racks may be nested one in another to provide a stacked display.

U.S. Pat. No. 4,775,054 relates to a multiple row display system for displaying products. The display system includes a rigid frame extending from a wall at a distance above the floor and a rigid retainer assembly extending from the wall between the frame and the floor. The frame and retainer assemblies define upper and lower compartments for receiving and holding the product. Optional peg hook assemblies can be attached to the frame for displaying different, smaller-sized products.

U.S. Pat. No. 4,865,205 relates to an elongate hanger element having a retaining rail connected at opposite ends and opposite side portions of a display board and a medial portion extending across and confining packages within the retaining rail. The retaining rail is of sufficient width to support advertising material thereon and is sufficiently narrow that the upper and lower portions of the packages are exposed to view by purchasers.

However, as previously mentioned, each of these known rack systems has its drawbacks. First, these systems are inflexible and not easily adaptable to any type of product. Further, these systems provide little or no vertical and/or horizontal variability when multiple racks are required. Still further, the systems are incapable of displaying merchandise "around-the-corner" for display and viewing of merchandise that is arranged in columns or at an end of a row.

A need, therefore, exists for an improved rack and display system that overcomes the disadvantages of known systems and provides greater flexibility and is not limited to specific types of merchandise for display on the racks of the system.

SUMMARY OF THE INVENTION

A display rack for use in a point-of-purchase merchandising system and a system for displaying merchandise are provided. The system and display racks of the system are capable of greater flexibility and variability and are not limited to display of a specific product.

To this end, in an embodiment, a system is provided for displaying merchandise. The system has a plurality of racks having a plurality of longitudinally extending rods substantially parallel to each other wherein the rods are bent to form an interior space between a surface on which each of the plurality of racks are mounted and a plurality of rods wherein each of the plurality of racks are mounted perpendicularly to the surface and are vertically displaced from each other.

In an embodiment, each of the plurality of racks extends a distance from the surface wherein the distance is different for each of the plurality of racks.

In an embodiment, the system has a shelf capable of mounting on the rods in the interior space between a surface and the rods.

In an embodiment, the surface on which the plurality of racks is mounted is a pegboard.

In an embodiment, the system has clips attachable to the rods on three sides of any one of the plurality of racks capable of displaying additional merchandise.

In an embodiment, the system has a suspendable rack attachable to the rods of any one of the plurality of racks capable of displaying additional merchandise.

In another embodiment, the system has a clip attachable to any one of the plurality of racks to prevent twisting of the rack.

In an embodiment, the plurality of rods for each of the plurality of racks is three.

In an embodiment, the interior space formed by the plurality of rods between the vertical surface is rectangular.

In another embodiment of the present invention, a display rack is provided for use in a point-of-purchase merchandising system. The rack has a first bracket attachable to a vertical surface. A second bracket is attachable to the vertical surface remote from the first bracket. A first plurality of rigid rods are connected to the first bracket and the second bracket and define an open interior space between the vertical surface, the first and second brackets and the first plurality of rigid rods when attached to the vertical surface.

In an embodiment, the first plurality of rigid rods are identically configured and connected to the first and second brackets to maintain a uniform vertical distance between the first plurality of rigid rods.

In an embodiment, a shelf is mountable on the first plurality of rigid rods to create a substantially horizontal planar surface in the open interior space.

In an embodiment, a plurality of clips are attachable to the first plurality of rigid rods to extend away from the open interior space. The plurality of clips may each have a first rod and a second rod vertically displaced and substantially parallel.

In an embodiment, a suspendable rack is attachable to the first plurality of rigid rods to extend away from the open interior space. The suspendable rack includes a second plurality of rigid rods connected to define an open interior space between brackets remotely situated wherein a bracket is attached to the first plurality of rigid rods.

In an embodiment, the rack has stabilizing clips attachable to at least one of the first bracket and the second bracket.

In an embodiment, the vertical surface to which the brackets are mounted is a pegboard.

In an embodiment, the open interior space formed between the vertical surface and the plurality of rods is rectangular.

In an embodiment, the number of the first plurality of rigid rods is three.

It is, therefore, an advantage of the present invention to provide a display rack and a system for displaying merchandise that is flexible and not limited to use with a specific type of merchandise.

Another advantage of the present invention is to provide a display rack and a system for displaying merchandise that has horizontal variability.

Yet another advantage of the present invention is to provide a display rack and a system for displaying merchandise that has vertical variability.

A still further advantage of the present invention is to provide a display rack and a system for displaying merchandise that is capable of "around-the-corner" display.

Moreover, an advantage of the present invention is to provide a display rack and a system for displaying merchandise that is simple to install and capable of simply varying after installation.

A still further advantage of the present invention is to provide a display rack and a system for displaying merchandise that is capable of saving space for displaying various types of merchandise.

And, another advantage of the present invention is to provide a display rack and a system for displaying merchandise that is both sturdy and stable.

Additional features and advantages of the present invention are described in, and will be apparent from, the detailed description of the presently preferred embodiments as well as the drawings.

DETAILED DESCRIPTION OF THE PRESENTLY PREFERRED EMBODIMENTS

A display rack is provided for use in a point-of-purchase merchandising system. Further, a system is provided for displaying merchandise providing greater flexibility and variability in displaying merchandise and which is not limited to the type of merchandise displayed.

Figure 1:
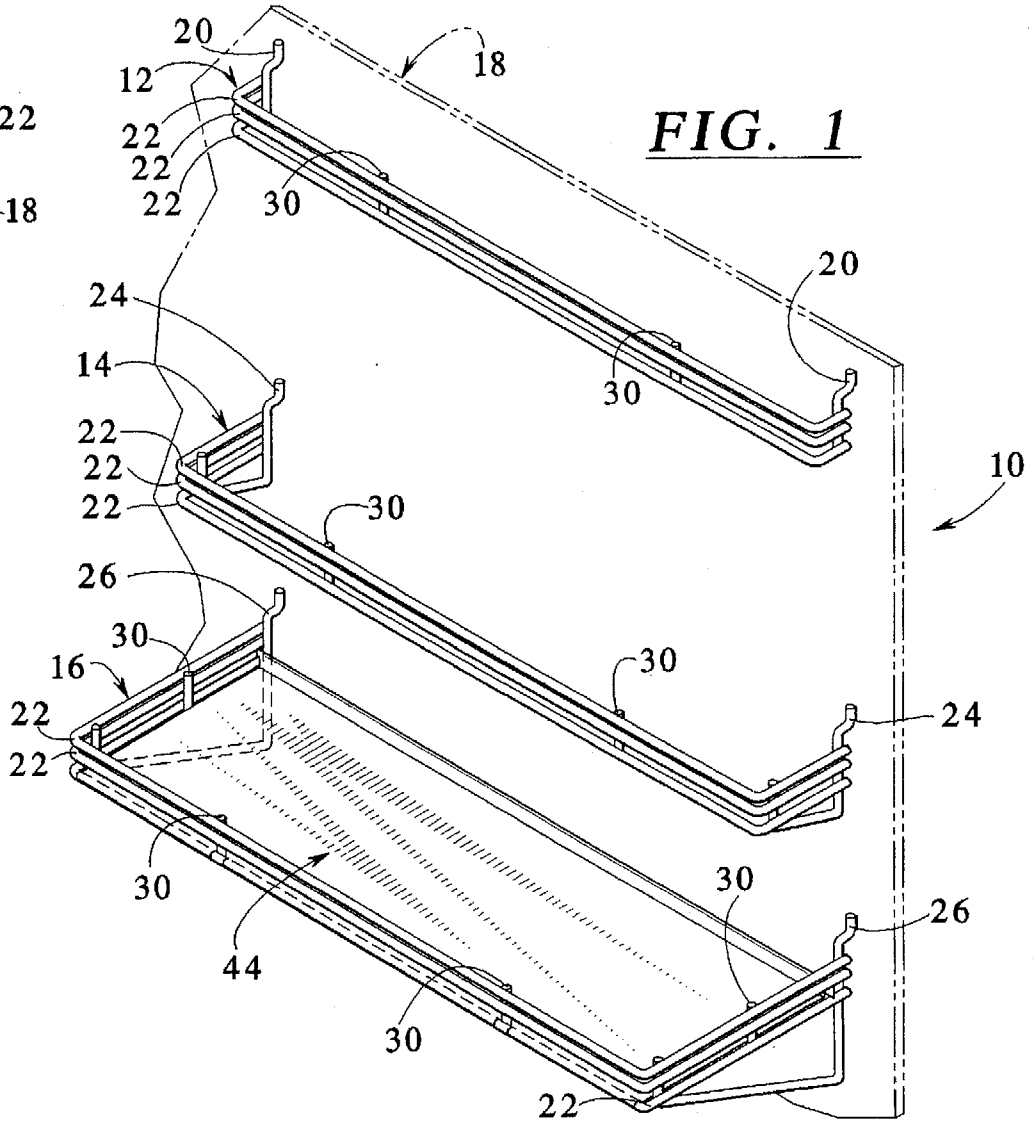
FIG. 1 illustrates a perspective view of an embodiment of a display system of the present invention.

Referring now to the drawings wherein like numerals refer to like parts, FIG. 1 illustrates an embodiment of a display system 10 including a plurality of racks 12, 14 and 16. The racks 12, 14 and 16 are attachable to a vertical surface 18, such as a wall. In a preferred embodiment, the vertical surface 18 is a pegboard. The first rack 12 includes a pair of brackets 20 on which longitudinal rods 22 are attached. Similarly, the second and third racks 14, 16 include brackets 24 and 26, respectively, to which longitudinal rods 22 are attached. One end of each of the brackets 20, 24 and 26 may be placed through an aperture 28 to secure the racks 12, 14 and 16 to the vertical surface 18. The longitudinal rods 22 are attached to their respective brackets 20, 24 and 26 such that a uniform spacing is maintained between the longitudinal rods 22. Reinforcing clips 30 may be added along the length of the longitudinal rods to maintain the uniform spacing between adjacent longitudinal rods 22.

Figure 2:
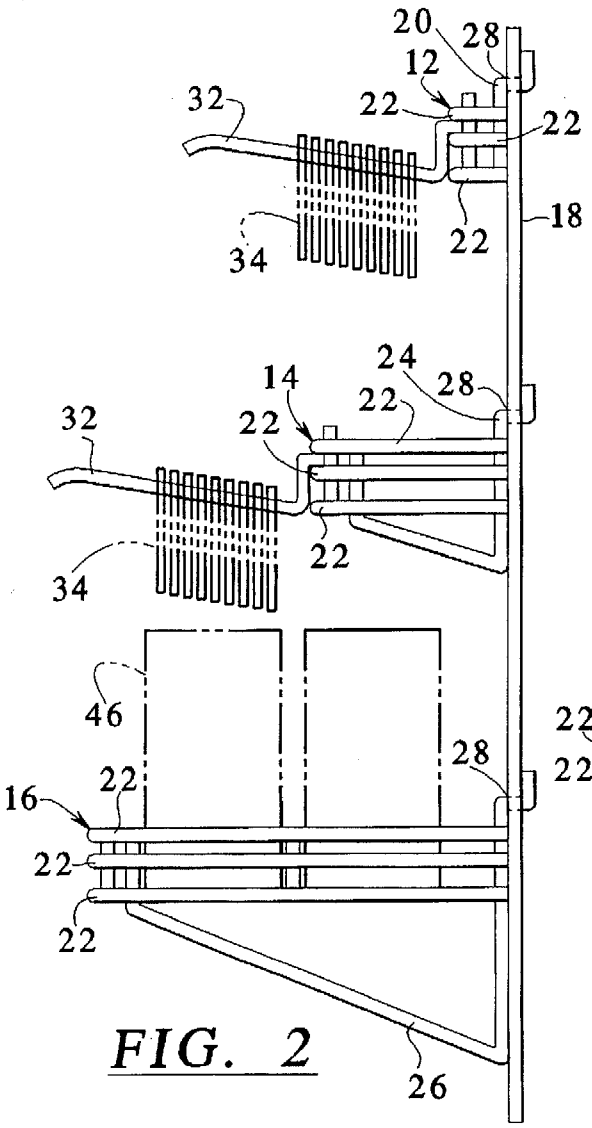
FIG. 2 illustrates a side elevational view of an embodiment of a system for displaying merchandise of the present invention.
Figure 3:
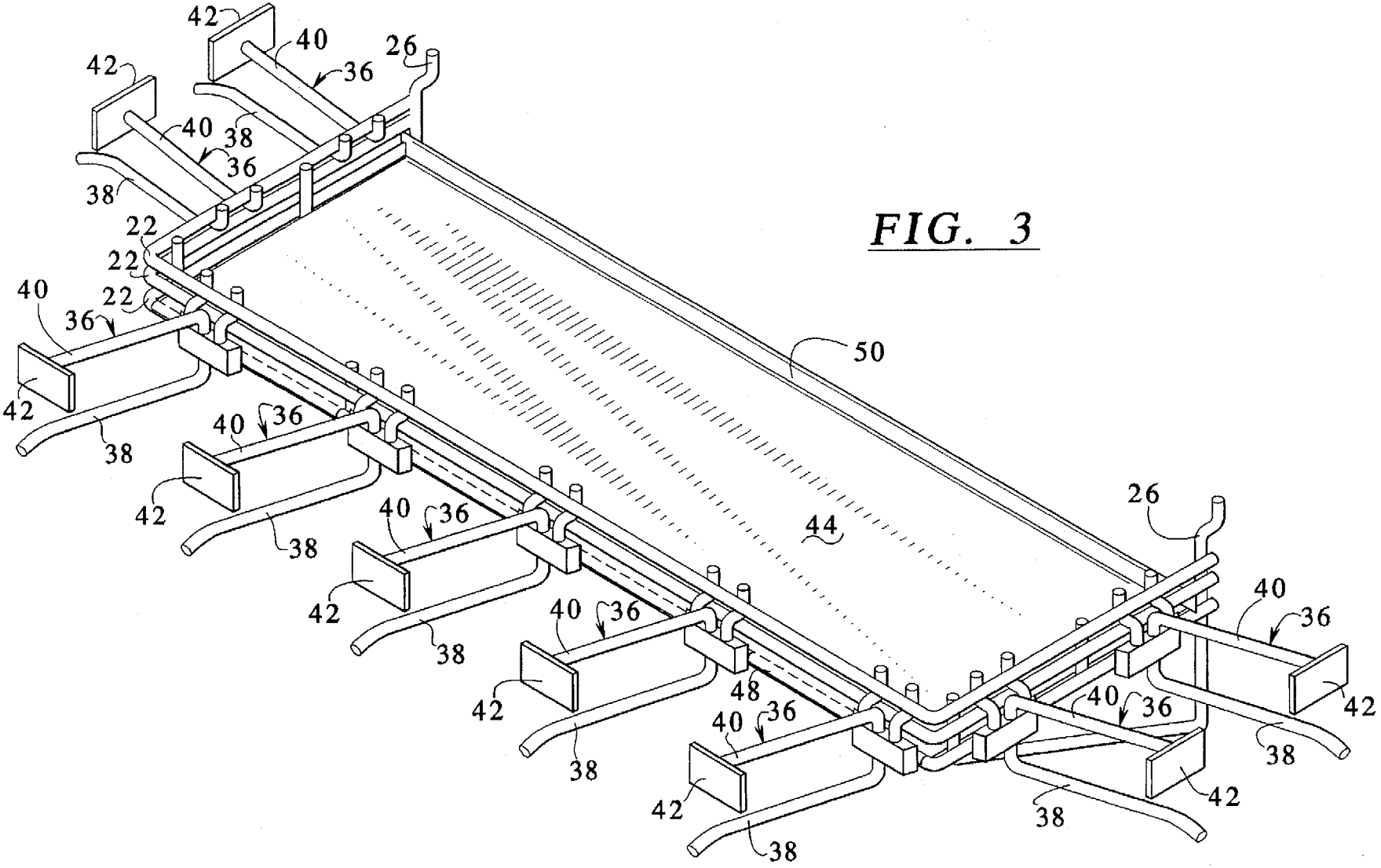
FIG. 3 illustrates a perspective view of an embodiment of a display rack for "around-the-corner" merchandising.

As shown in FIG. 2, between a pair of adjacent longitudinal rods 22, a peg hook 32 may be secured. To this end, the peg hook 32 is designed to fit between adjacent longitudinal rods 22 and positionable at any point along a front side or along the sides as shown in FIG. 3. The peg hook 32 is capable of receiving merchandise 34 on an extending arm away from the longitudinal rods.

As shown in FIG. 3, a multi-armed peg hook 36 is illustrated with a first arm 38 capable of holding merchandise similar to that shown in FIG. 2. A second arm 40 is vertically displaced from the first arm 38. In a preferred embodiment, the second arm 40 includes a tag 42 for displaying information regarding the merchandise, such as identification and/or price or the like. Of course, other peg hook configurations with or without the tag may be implemented by those skilled in the art. The particular configuration of the peg hooks and/or tags are not deemed to be limiting to the present invention. FIG. 3 clearly illustrates the "around-the-corner" merchandising that the present invention advantageously provides due to the unique construction of the racks 12, 14 and 16.

Referring again to FIGS. 1–3, any one or more of the racks 12, 14 and/or 16 may be provided with a shelf 44. As shown in FIGS. 1 and 2, the shelf 44 is provided on the bottom rack 16 and is mountable between adjacent longitudinal rods 22 of the bottom rack 16. The shelf 44 is capable of holding merchandise 46, such as the boxes, illustrated in FIG. 2. The shelf 44 may include a front lip 48 attachable to one of the longitudinal rods 22 of the rack 16. Further, the shelf 44 may include an inclined rear edge 50 as shown in FIG. 3. Of course, any of the racks 12, 14 and/or 16 may be provided with a shelf. Further, the shelf may be configured such that a lip is attachable to the side portions of the longitudinal rods and/or the front portion as shown in FIG. 3. Further, the edge 50 may be provided on more than one side of the shelf 44 depending on the application for which the shelf 44 is used. However, in the embodiments illustrated, the racks themselves create the lips on the three sides not including the edge 50.

Figure 4:
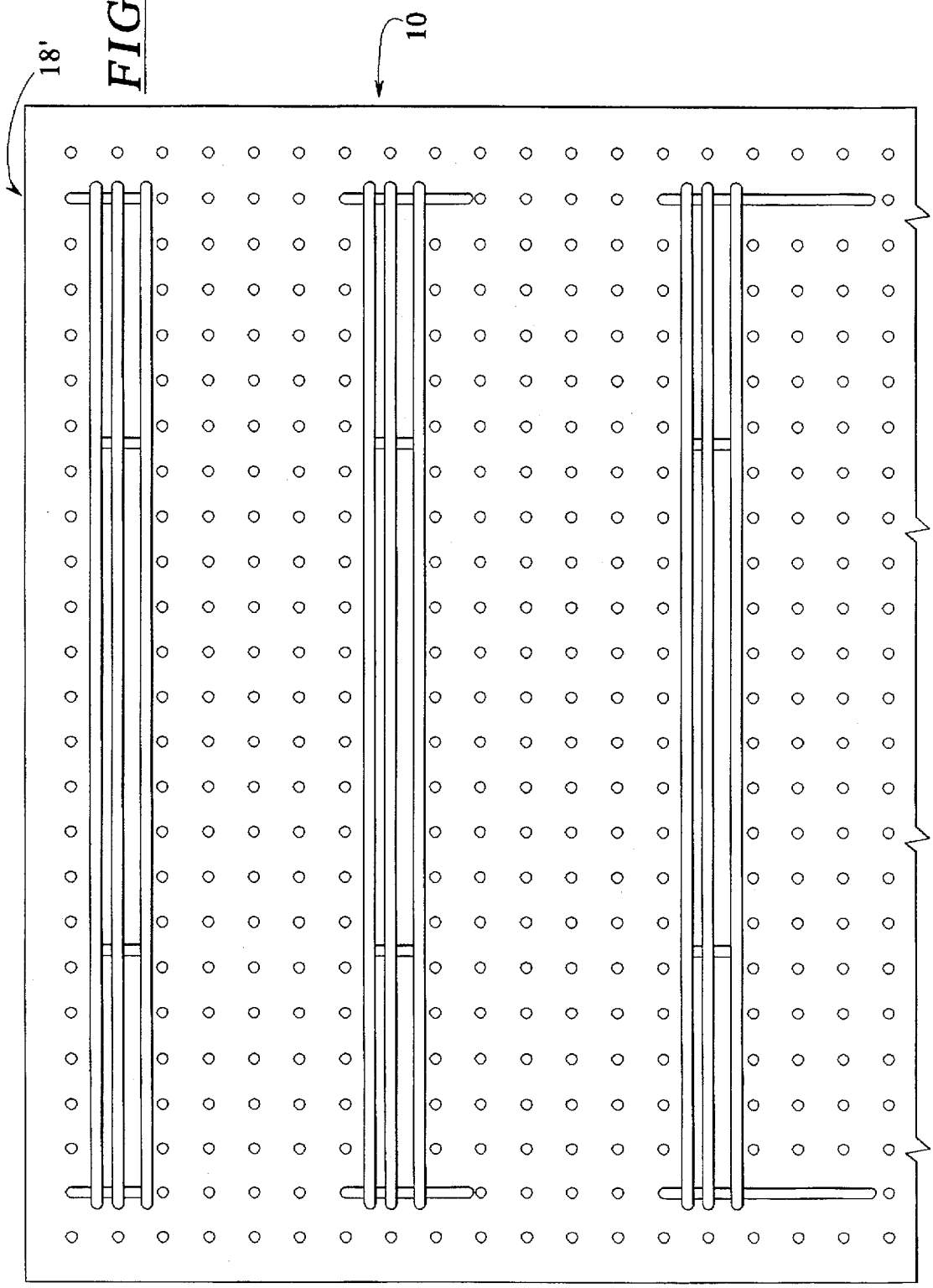
FIG. 4 illustrates a front elevational view of an embodiment of a system for displaying merchandise of the present invention.

Referring now to FIG. 4, the display system 10 is shown on a pegboard 18' acting as the vertical surface or the display system. When the pegboard 18' is used, the racks 12, 14 and/or 16 may be easily moved to any location on the pegboard 18' only limited to the location of the apertures. While three racks 12, 14 and 16 have been shown throughout the figures, it should be understood that any lesser number or greater number of racks may be implemented depending on the particular embodiment.

Figure 5:
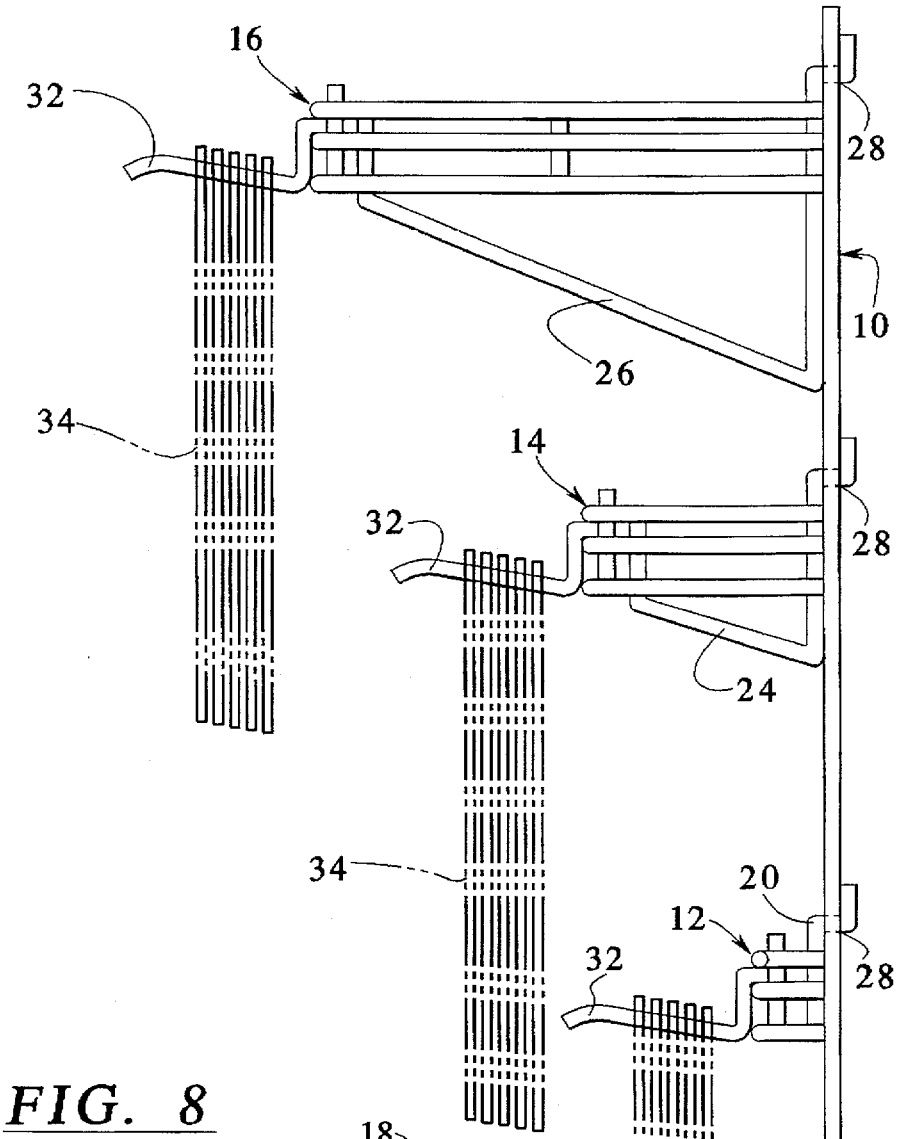
FIG. 5 illustrates a side elevational view of an embodiment of a system for displaying merchandise of the present invention.
Figure 6:
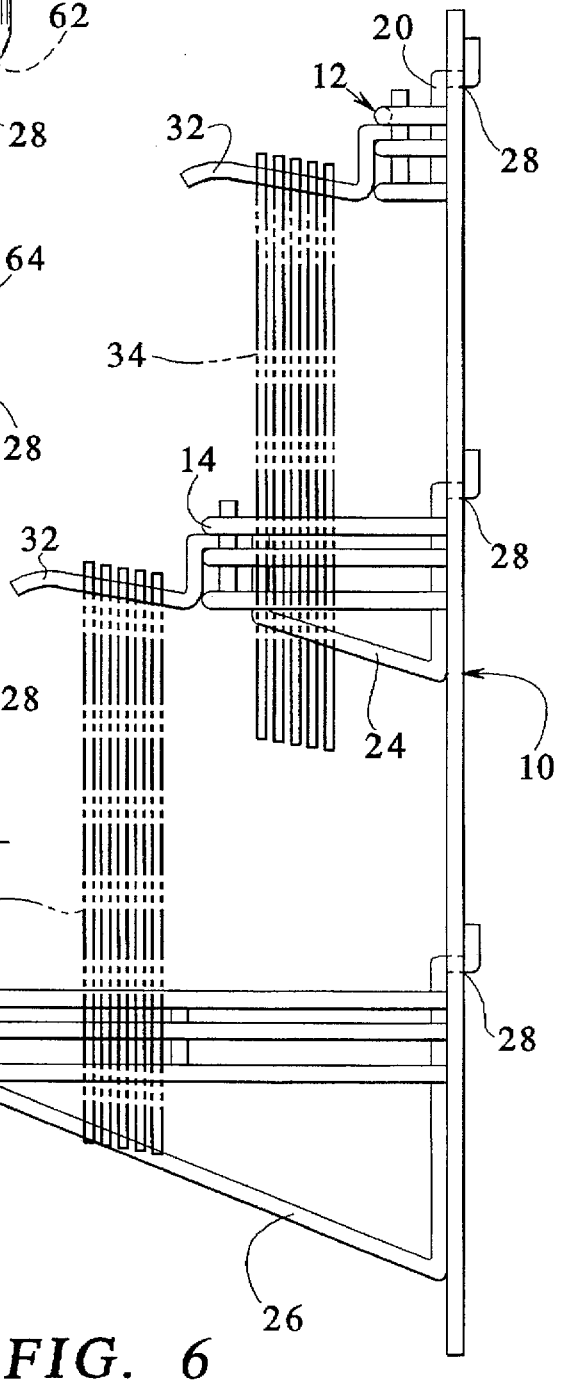
FIG. 6 illustrates a side elevational view of another embodiment of a system for displaying merchandise of the present invention.
Figure 11:
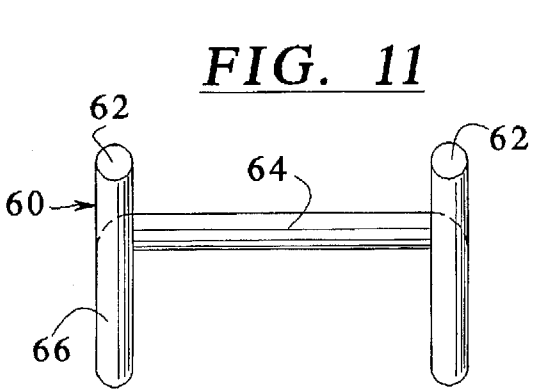
FIG. 11 illustrates a top elevational view of an embodiment of a stabilizing clip for use with a rack in the system of the present invention.
Figure 10:
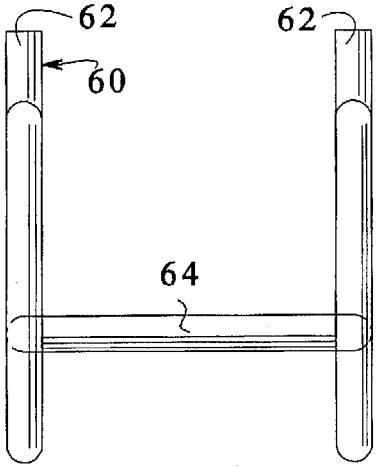
FIG. 10 illustrates a front elevational view of an embodiment of a stabilizing clip for use with a rack of the present invention.
Figure 9:
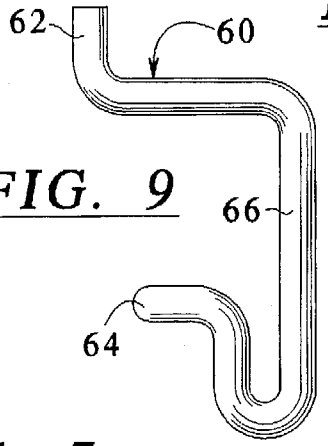
FIG. 9 illustrates a side elevational view of a stabilizing clip for use with a rack in an embodiment of the present invention.

FIGS. 5 and 6 illustrate how the rack system 10 of the present invention advantageously acts as a space saver for different applications. Each of the display systems 10 shown in FIGS. 5 and 6 provide a "waterfall" effect since the merchandise displayed from each of the display systems 10 overlaps between the racks 12, 14 and 16. The embodiment illustrated in FIG. 5 further allows a shelf (not shown) to be placed in the rack 16 for display of merchandise on the shelf without obstruction of the merchandise 34 suspended from the peg hooks 32. Likewise, a shelf (not shown) may be added to the rack 12 of FIG. 6, and merchandise may be placed on the shelf without being obstructed by the merchandise 34 on the peg hooks 32. Of course, the size of the shelf implemented in the rack 12 would be relatively small and a different configuration of wires that make up the shelf 12 would be required as shown and described with references to the shelves 14, 16.

Figure 8:
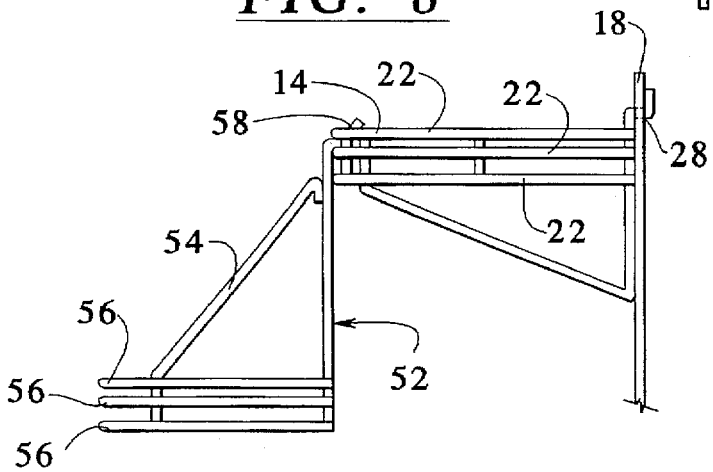
FIG. 8 illustrates a side elevational view of an embodiment of a suspended rack for attaching to a display rack in an embodiment of the present invention.
Figure 8:
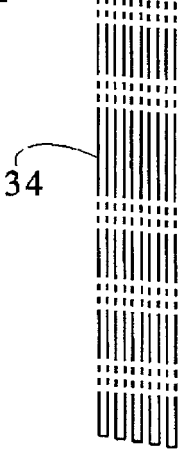
Figure 12:
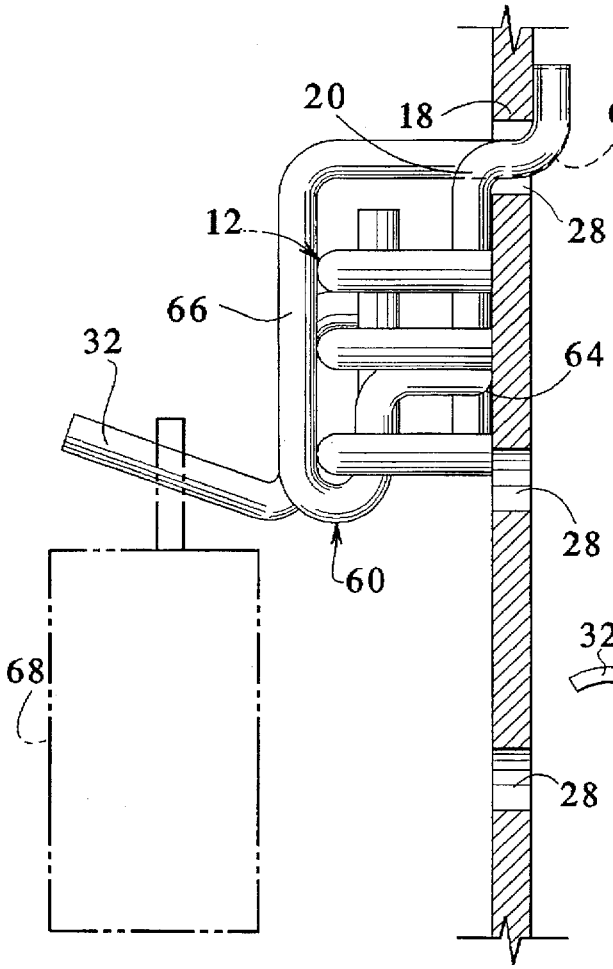
FIG. 12 illustrates a side view of an embodiment of a rack using a stabilizing clip of the present invention.

Another embodiment of the display system 10 of the present invention is illustrated in FIG. 8. As shown, rather than attaching the peg hook 32 and/or 36 to the rack 12, 14 or 16, an additional rack 52 may be attached between adjacent longitudinal rods 22 of the rack 14 to suspend therefrom as illustrated in FIG. 8. The rack 52 includes a bracket 54 at each end thereof with longitudinal rods 56 connected thereto. As a result, a shelf (not shown) may be placed between adjacent longitudinal rods 56 like that described with reference to FIGS. 1–3 and the bracket 16. Or, additional brackets, like the peg hooks 32 and/or 36 may be secured between the adjacent longitudinal rods 56. This additional rack 52 forms an additional, but abbreviated level, and the "waterfall" effect. Again, this additional rack 52 creates additional space without eliminating peg hook space on the vertical surface 18. In order to implement use of the rack 52 with another rack, such as the rack 14, a connector 58 formed with the bracket 54 is angled less than 90° so that the longitudinal rods 56 are level with the longitudinal rods 22 of the bracket Referring now to FIGS. 9–12, a clip 60 is illustrated. The clip 60 is attachable to a vertical surface 18 through an aperture 28 much like the bracket 20 of the rack 12. The clip 60 includes a first end 62 securable through the aperture 28 of the vertical surface 18. A second end 64 is configured in the same plane, but perpendicular to the end 62 such that the end 64 abuts the surface 18 without penetration of an aperture 28. The second end 64 is configured as a transverse rod transverse to a length of the vertical surface 18 and a connecting body portion 66 configured between the first end 62 and the second end 64. The clip 60, therefore, acts to stabilize and prevent twisting of the rack 12 in the event a heavy object 68 is suspended from the peg hook 32, such as illustrated in FIG. 12. To this end, the clip 60 is designed to capture the parallel longitudinal rods of the bracket 12 on one side exterior to the bracket 12 and extend around the bracket 12 and attach to the vertical surface 18. Likewise, similarly configured clips 60 may be implemented for the racks and 16. The clips 60, of course, may also be used for stabilization when the racks 12, 14 and/or 16 are used with a shelf.

Figure 7:
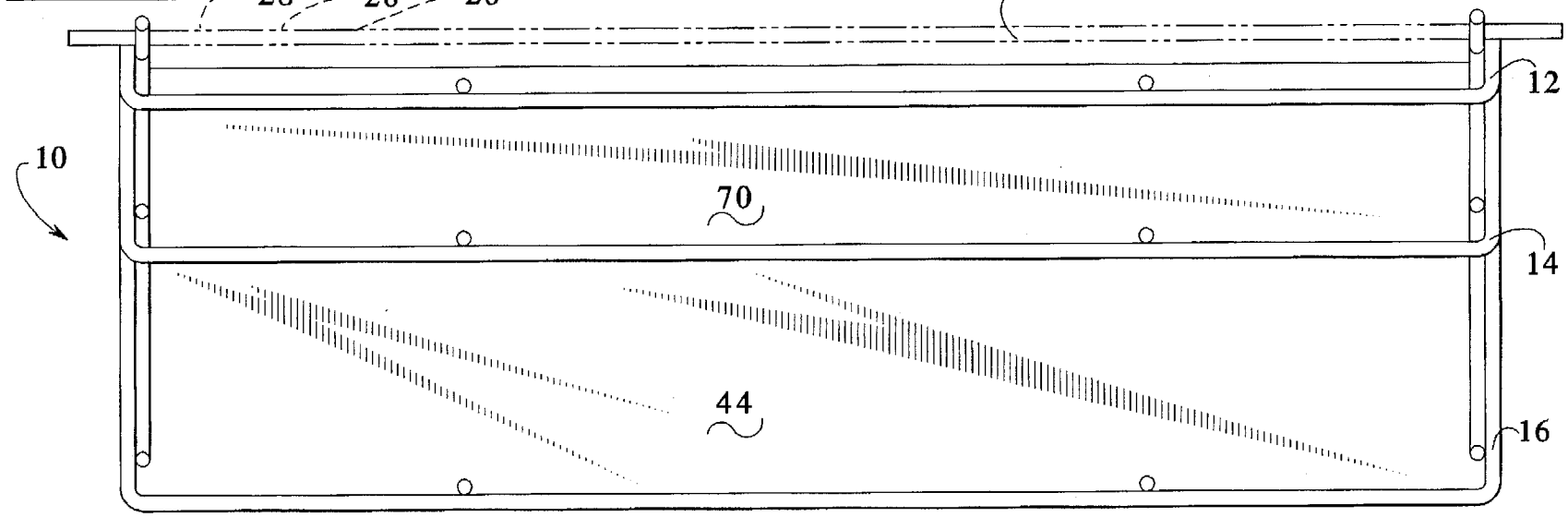
FIG. 7 illustrates a top plan view of an embodiment of a system for displaying merchandise of the present invention.

Referring now to FIG. 7, a top view of the display system 10 is shown with the three racks 12, 14 and 16 attached to the pegboard 18' having a plurality of apertures throughout. The embodiment illustrated shows the bottom rack 16 with the shelf 44 thereon. Similarly, a second shelf 70 has been added to the middle rack 14.

As should be appreciated from the foregoing, the rack system 10 provides great flexibility and adjustment of any of the racks both vertically and horizontally. Further, the positioning of the racks with respect to one another may be easily adjusted depending on the merchandise being displayed. Further, the rack provides for "around-the-corner" merchandising of products.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

I claim:

1. A system for displaying merchandise comprising:

a plurality of racks each having a plurality of longitudinally extending rods substantially parallel to each other wherein the rods are bent at each end forming a leg at each end of each of the plurality of rods wherein the legs at each end of each one of the plurality of racks is equal in length such that each one of the plurality of racks is capable of being flushly mounted on a surface with the legs extending perpendicular to the surface and further wherein the lengths of the legs on adjacent racks is unequal and further wherein each of the plurality of racks is distinctly formed from one another such that each of the plurality of racks forms an empty interior space between the surface on which each of the plurality of racks are mounted and the plurality of rods wherein each of the plurality of racks are mounted perpendicularly to the surface and are vertically displaced from each other.

2. The system of claim 1 further comprising:

a solid shelf capable of mounting on the rods in the interior space between the surface and the rods.

3. The system of claim 1 wherein the surface is a pegboard.

4. The system of claim 1 further comprising:

clips having a finite length attachable to the rods at any point on three sides of any one of the plurality of racks capable of displaying additional merchandise wherein the clips extend in a plane parallel to the legs.

5. The system of claim 1 further comprising:

a suspendable rack having a plurality of longitudinally extending rods substantially parallel to each other and an arm perpendicular to the rods and attachable to the rods of any one of the plurality of racks capable of displaying additional merchandise.

6. The system of claim 1 further comprising:

a clip attachable to any one of the plurality of racks to prevent twisting of the rack.

7. The system of claim 1 wherein the plurality of rods for each of the plurality of racks is three.

8. The system of claim 1 wherein the interior space is rectangular.

9. A display rack for use in a point-of-purchase merchandise system, the rack comprising:

a first bracket attachable by an integral hooked end thereof to a vertical surface;

a second bracket attachable by an integral hooked end thereof to the vertical surface remote from the first bracket; and a first plurality of rigid rods connected to the first bracket and the second bracket and defining an empty interior space between the vertical surface, the first and second brackets and the first plurality of rigid rods when attached to the vertical surface wherein each of the first plurality of rigid rods are identically configured and each are further connected to the first and second brackets to maintain a uniform vertical distance between each of the first plurality of rigid rods wherein the first and second brackets extend parallel to the vertical surface to which they are attached and each of the first plurality of rigid rods extend perpendicularly to the vertical surface at points at which the rigid rods are attached to the first and second brackets.

10. The display rack of claim 9 further comprising:

a solid shelf mountable in the empty interior space defined by the first plurality of rigid rods to create a substantially horizontal planar surface.

11. The display rack of claim 9 further comprising:

a plurality of clips attachable to the first plurality of rigid rods to extend away from the empty interior space.

12. The display rack of claim 9 further comprising:

a suspendable rack attachable to the first plurality of rigid rods to extend away from the empty interior space.

13. The display rack of claim 12 wherein the suspendable rack includes a second plurality of rigid rods connected to define an empty interior space between brackets remotely situated wherein the brackets attach to the first plurality of rigid rods.

14. The display rack of claim 9 further comprising:

stabilizing clips attachable to at least one of the first bracket and the second bracket.

15. The display rack of claim 11 wherein the plurality of clips each have a first rod and a second rod vertically displaced and substantially parallel.

16. The display rack of claim 9 wherein the vertical surface is a pegboard.

17. The display rack of claim 9 wherein the empty interior space is rectangular.

18. The display rack of claim 9 wherein the first plurality of rigid rods is three.

* * * * *